US006769357B1

(12) United States Patent
Finan

(10) Patent No.: US 6,769,357 B1
(45) Date of Patent: Aug. 3, 2004

(54) DIGITAL CAN DECORATING APPARATUS

(75) Inventor: Joseph Finan, Las Vegas, NV (US)

(73) Assignee: Sequa Can Machinery, Inc., East Rutherford, NJ (US)

( * ) Notice: Subject to any disclaimer, the term of this patent is extended or adjusted under 35 U.S.C. 154(b) by 0 days.

(21) Appl. No.: 10/455,128

(22) Filed: Jun. 5, 2003

(51) Int. Cl.[7] ..... B41F 17/08
(52) U.S. Cl. ..... 101/38.1; 101/483; 347/2
(58) Field of Search ..... 101/38.1, 39, 40–41, 101/40.1, 483, 484, 487, 35, 44, 114, 115; 347/2

(56) References Cited

U.S. PATENT DOCUMENTS 3,563,170 A * 2/1971 Cvachio et al. ..... 101/40
3,628,451 A * 12/1971 McClellan et al. ..... 101/35
3,766,851 A 10/1973 Sirvet et al.
4,078,483 A * 3/1978 Gall ..... 101/44
4,889,050 A * 12/1989 Meador ..... 101/38.1
4,906,170 A * 3/1990 Nelson et al. ..... 347/2
5,029,523 A 7/1991 Fields
5,065,183 A 11/1991 Morofuji et al.
5,207,153 A * 5/1993 Thomason ..... 101/35
5,282,306 A * 2/1994 Katsuhiro et al. ..... 283/81
5,553,547 A 9/1996 Miller
5,799,574 A 9/1998 Williams et al.
5,831,641 A * 11/1998 Carlson ..... 347/2
6,000,329 A * 12/1999 Averill ..... 101/35
6,135,654 A * 10/2000 Jennel ..... 101/35
6,367,380 B1 4/2002 Whelan
6,397,740 B1 * 6/2002 Dubuit ..... 101/41
2002/0162472 A1 * 11/2002 Liguori et al. ..... 101/487
2003/0010229 A1 * 1/2003 Fujita et al. ..... 101/38.1

* cited by examiner

*Primary Examiner*—Eugene H. Eickholt
(74) *Attorney, Agent, or Firm*—Mitchell D. Bittman; Robert Faber

(57) ABSTRACT

A digitally controlled can printing apparatus for printing on circular two-piece cans, the apparatus including digital print-heads for printing an image on the cans and drives for transporting and rotating the cans in front of the print-heads in registered alignment.

24 Claims, 5 Drawing Sheets

DIGITAL CAN DECORATING APPARATUS

BACKGROUND OF THE INVENTION

1. Field of the Invention

The present invention relates to decorating apparatus for decorating an object, particularly, a circular object, and in a particular application, for decorating a can, and particularly to a digital can decorating apparatus for digitally controlled printing on two-piece cans. Although the disclosure herein describes the invention as applied to decoration of cans, the invention is applicable to decorating any object, and particularly a generally cylindrical or round object which is adapted to be supported, and particularly rotated, in opposition to a digitally controlled printing head.

2. The Prior Art

Conventionally, two-piece cans are decorated by offset printing. In such a process each color ink is contained in a separate inking station that transfers the ink to a blanket. These inks are then simultaneously applied from the blanket to the can in register. If a different image is desired to be printed or a change is desired in the image, it is necessary to completely change the printing plate on which the image is fixed. During changing of the ink colors, the ink distribution rolls must be cleaned to avoid contamination of the new color by the previous color. A representation of such a known device is shown in FIG. 1.

Further examples of such, or similar, can printing devices are known from U.S. Pat. Nos. 3,766,851, 5,799,574 and 6,367,380. U.S. Pat. No. 5,799,574 discloses a relatively high speed apparatus for applying decorations to the exterior of cylindrical containers while they are mounted on mandrels which are disposed along a periphery of a large continuously rotating disk-carrier. Decorations are applied to the containers as they engage a rotating blanket of a decorator that is adjacent the periphery of the carrier. During engagement between the containers and the blanket the containers track the blanket surface through the printing region where the containers and the blanket surface are engaged. This type of decorating equipment includes a number of relatively heavy elements that move at high speed. Because there must be precise coordination between the various elements, inertia forces, lubrication and operating power are significant engineering design considerations, as are equipment down time, maintenance, cost and setup procedures.

Although these prior art devices are functional, they are mechanically quite complex and contain a large number of components which must be controlled during printing and maintained so as to provide images that are uniform in appearance from one can to the next.

Digital printing is used in many environments. Digital printing might be broadly defined as printing without use of printing plates. An example of digital printing is inkjet printing, of which there are several different techniques including the use of a piezo element to apply pressure to a nozzle chamber to force a drop of ink onto a medium, continuous ink supply with required ink droplets channeled onto the medium, thermal printing where a gas bubble in a nozzle chamber creates pressure forcing an ink droplet onto the medium, or ink in solid form is melted as needed and then applied like a liquid ink jet. Ink might be sprayed by a spray jet. Other non-plate techniques of applying ink include thermal wax or resin tracer, dye sublimation, etc. Use of a particular technique of digital printing is not required for performance of the present invention. Inkjet printing overrides the various steps and apparatus associated with producing and mounting and setting plates. With respect to the use of digital printing in can decoration, the additional need for a blanket wheel for cooperating with inkers is avoided.

Apparatus for adapting digital printing technique to decorating of cans or container, and of the type of the present invention, has not previously been disclosed.

SUMMARY OF THE INVENTION

Accordingly, it is an object of the present invention to provide an apparatus for a non-contact printing of images on objects, particularly round objects, more particularly cans and specifically two-piece cans, which apparatus, relative to the prior art, is mechanically simple and without a large number of parts. Decoration of cans is described herein as one application of the apparatus. Pursuant to this object, and others which will become apparent hereafter, the present invention provides apparatus for digitally controlled printing directly on the objects or two-piece cans without the need for an intermediate printing blanket.

The inventive apparatus includes means for digitally and electronically controlling the timing and configuration of a printed image on a can surface. Such digitally controlled means may include any known type of non-contact print-head, such as an ink jet print-head. Furthermore, the inventive apparatus includes means for transporting the cans in an indexed fashion in front of or opposed to the print-heads and for rotating the cans in registered alignment from one print-head to the next.

Each of the print-heads is preferably operative to print a single color ink.

Each can is held on a rotatable turret by a respective one of a plurality of mandrels supported on the turret. Each mandrel is driven to rotate on its own axis by a respective servo motor. Each can to be printed is mounted on a respective one of the mandrels. The servo motors rotate and register the mandrels, with the cans mounted thereon, in front of the print-heads which print a respective part of the entire image that is to be printed on the cans.

The mandrel turret is rotated by an indexing drive, such as a servo motor, so that the mandrels follow a circular movement as the turret rotates and so that each mandrel with a can thereon pauses in front of each print-head for a period of time sufficient to permit digitally controlled printing on the can and rotation of the servo motor for registering the can to the image being printed. The turret is mounted to its servo motor by a support shaft. The servo motor and the support shaft are mounted on a main support, such as a Rutherford decorator support, which is in turn mounted on a machine base.

A valve arrangement provided on the support shaft and the turret connect supplies of vacuum and/or of compressed air to each of the mandrels for initially holding and thereafter releasing the cans on the mandrels.

A computer controls the indexed rotation of the turret as well as the rotation and, registering of the cans in front of the print-heads. Digital control of the individual print-heads may also be by the same computer. This computer control allows tremendous flexibility in the control of the printing apparatus itself as well as in the ability to instantaneously change the image being printed.

An additional support is provided for holding the print-heads so that they are directed toward the mandrels mounted on the turret as the mandrels move along the circular path of movement.

In another embodiment of the invention, two groups of print-heads are provided on the additional support. One group of print-heads is arranged on a circular arc having a radius smaller than the radius of the circular path of movement of the mandrels while the other group of print-heads is arranged on a circular arc having a radius larger than the radius of the circular path of movement of the mandrels. In this way the mandrels, together with the cans mounted thereon, are rotated on the turret between the two groups of print-heads. Each print-head in one group is positioned to oppose, i.e. on the same radius as, a respective print-head of the other group so that the cans are printed on from opposite directions as they pass between the print-heads.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described therein.

DESCRIPTION OF THE PREFERRED EMBODIMENTS

The preferred embodiments are described for decorating on cans. But that is only one application of the invention. The invention can be used to decorate any objects that are moved relative to print heads, especially circular objects or other objects that are rotated to expose their surface for printing.

Figure 1:
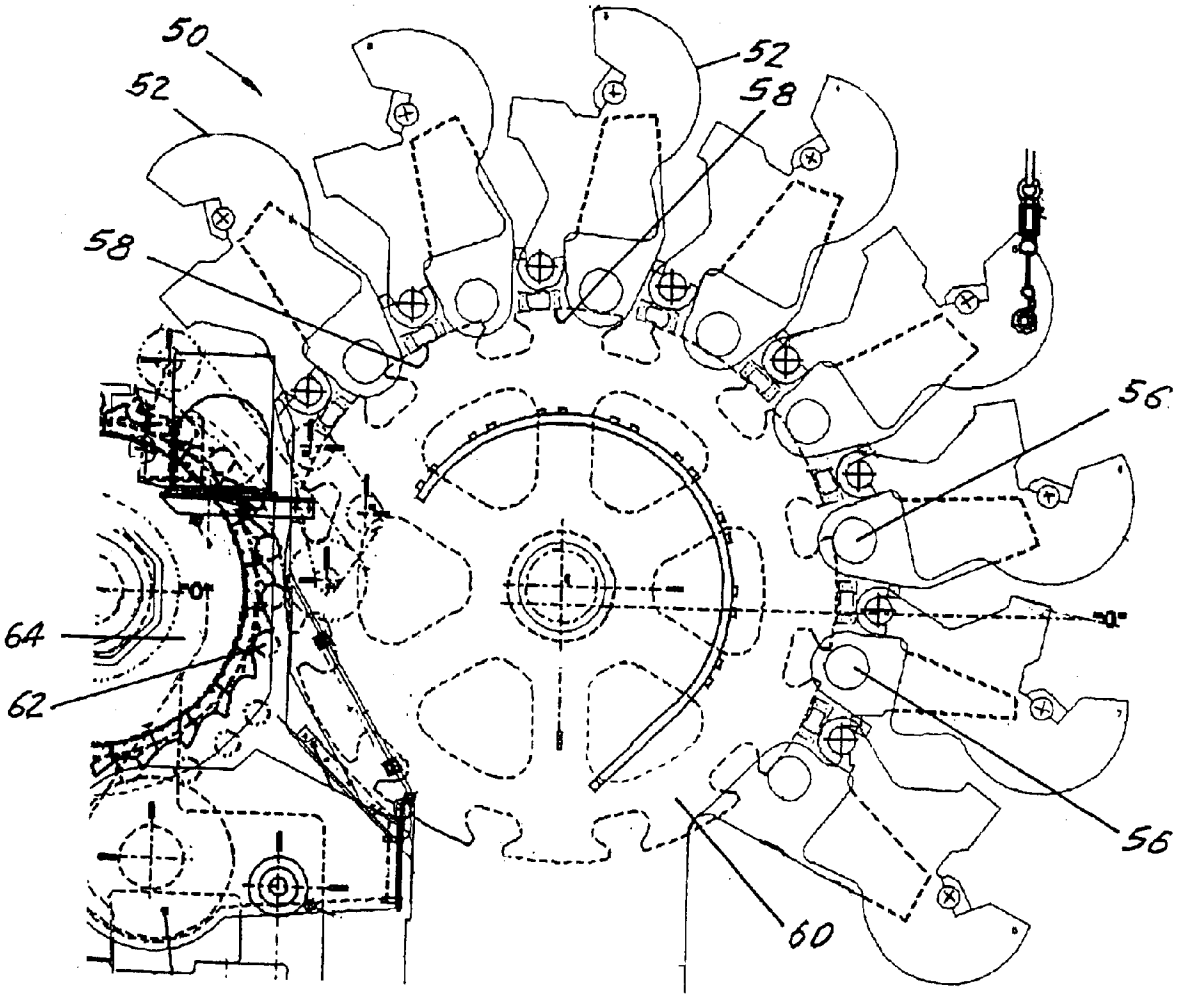
Fig. 1 Prior Art
FIG. 1 is a view of a prior art offset printing apparatus.

The state of the art of decorating cans, e.g. two-piece image cans, is disclosed in prior art, such as above-mentioned U.S. Pat. No. 5,799,574. The relevant portions of such prior art apparatus is seen in FIG. 1 where the printing apparatus 50 includes a plurality of inkers 52, each for supplying a particular ornamental pattern component in one color. Eight inkers 52 are shown, allowing printing of up to eight different patterns and/or eight different colors. The inkers include an ink receiving section and the ink is transmitted radially inwardly to the plate cylinders 56 which transfer the image in a particular color from each of the inkers to a respective inking blanket 58 on the blanket wheel 60.

The blanket wheel rotates in one direction, here counter-clockwise and each blanket is in turn brought against the surface of a respective can 62 being carried around on a mandrel on the can wheel 64 so that the image printed on each blanket 58 is received from the operative ones of the inkers 52 and the image is transferred to the cans 62. After being printed, the cans are sent for subsequent treatment in the usual manner, e.g. over-varnishing, curing, etc.

The invention enables avoidance of the need for inkers 52 and the blanket wheel 60.

Figure 2:
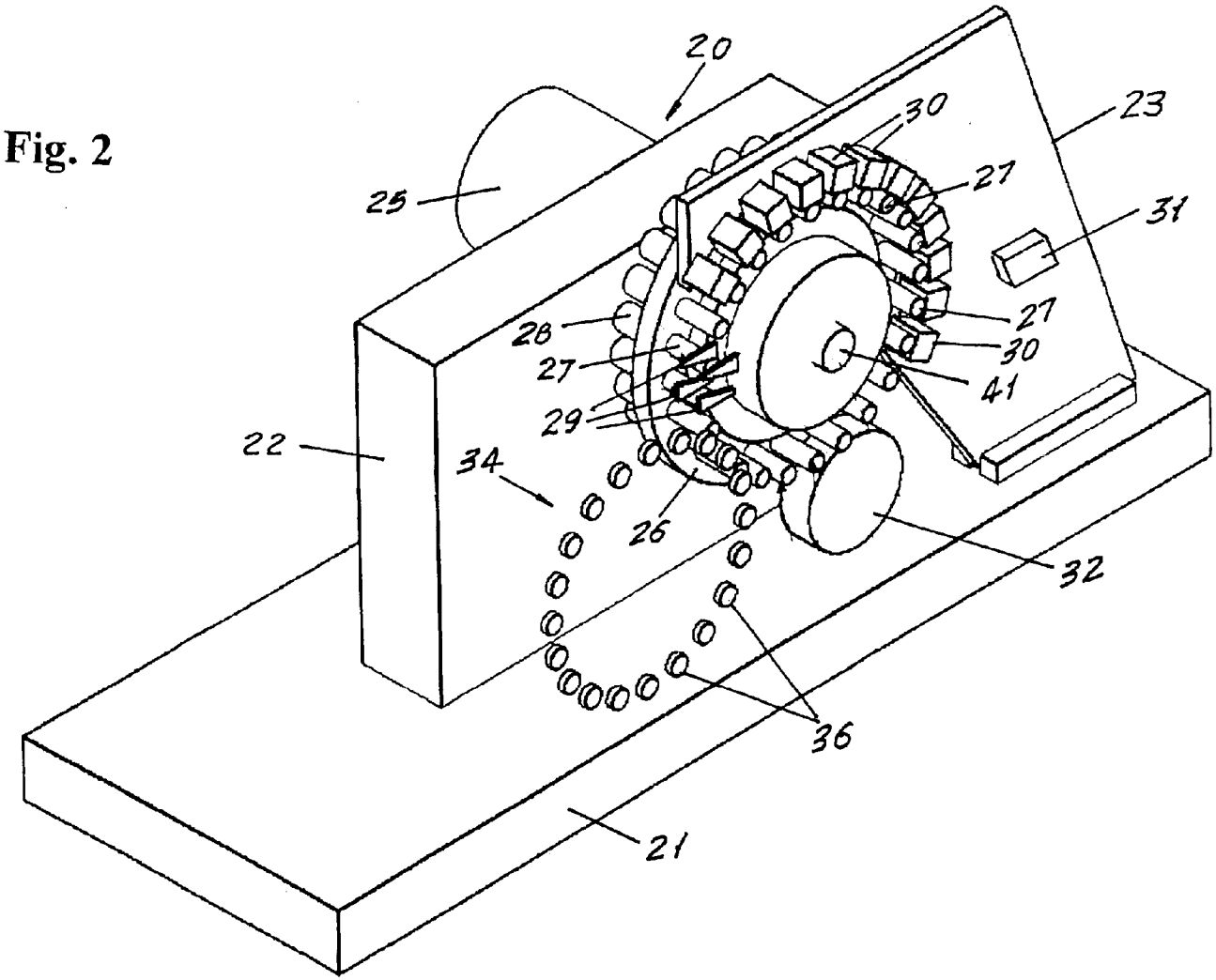
FIG. 2 is an isometric schematic view of the inventive decorating apparatus.

FIG. 2 generally and schematically shows a digital print-head apparatus for decorating cans, according to the invention.

In place of the inkers and blanket wheel of the prior art which is shown in FIG. 1, for example, FIG. 2 shows the apparatus 20 including a base 21 on which a main support 22 stands. Forward of the main support 22 on the base 21 is a print-head support 23.

There is a turret type indexing apparatus 25 supported on the main support 22 and it rotates a turret 26 around its center axis. The turret supports a plurality of can holding mandrels 27 that rotate with the turret 26. Each mandrel is of conventional design, as in U.S. Pat. Nos. 6,167,805 or 6,467,609 incorporated herein by reference, including a conventional servo motor behind the turret at 28 for rotating each mandrel 27 around its own axis. The mandrels 27 also rotate around their axes on the turret.

A conventional in-feed station 29 for the cans receives the cans from a supply chute and delivers the cans for being drawn onto the mandrels by suction.

A plurality of digital print-heads 30 are aligned around an arcuate part of the circular path of the mandrels as the turret rotates. Each print-head 30 is a digital print-head of a known type which delivers a particular color ink in a preselected digitally controlled pattern to the surface of a canon the mandrel that is then radially aligned with or at the particular print-head. In the illustrative example, twelve print-heads 30 are illustrated in FIG. 2, but the number of print-heads on a support 23 is a matter of choice. Providing twelve digital print-heads makes it possible to print up to twelve different ink colors and/or twelve different patterns or to print several repeats of the same colors or patterns, e.g. four color printing of cans may permit three separate repetition printing patterns to be printed in one rotation of mandrels past twelve print-heads. Conventional controls rotate the turret, sense the locations of the mandrels with respect to the print-heads, stop the turret with the cans at selected print heads, spin the mandrels and the cans at a preselected rate at the print-heads, and activate the print-heads at the appropriate time for printing the selected color and pattern on the can.

One or more reservoirs of ink for the digital print-heads is provided at 31 on the print-head support and is connected to the print-head support for supplying ink as required to each of the print-heads.

Following the printing, the printed cans are rotated by the turret to be varnished at the varnishing station 32. Thereafter, the mandrels arrive at the transfer station 34, and the individual now decorated and varnished cans are transferred by the mandrel operating system 41 to individual transfer elements 36 at the transfer station which then carry the decorated cans to further treatment.

Figure 3:
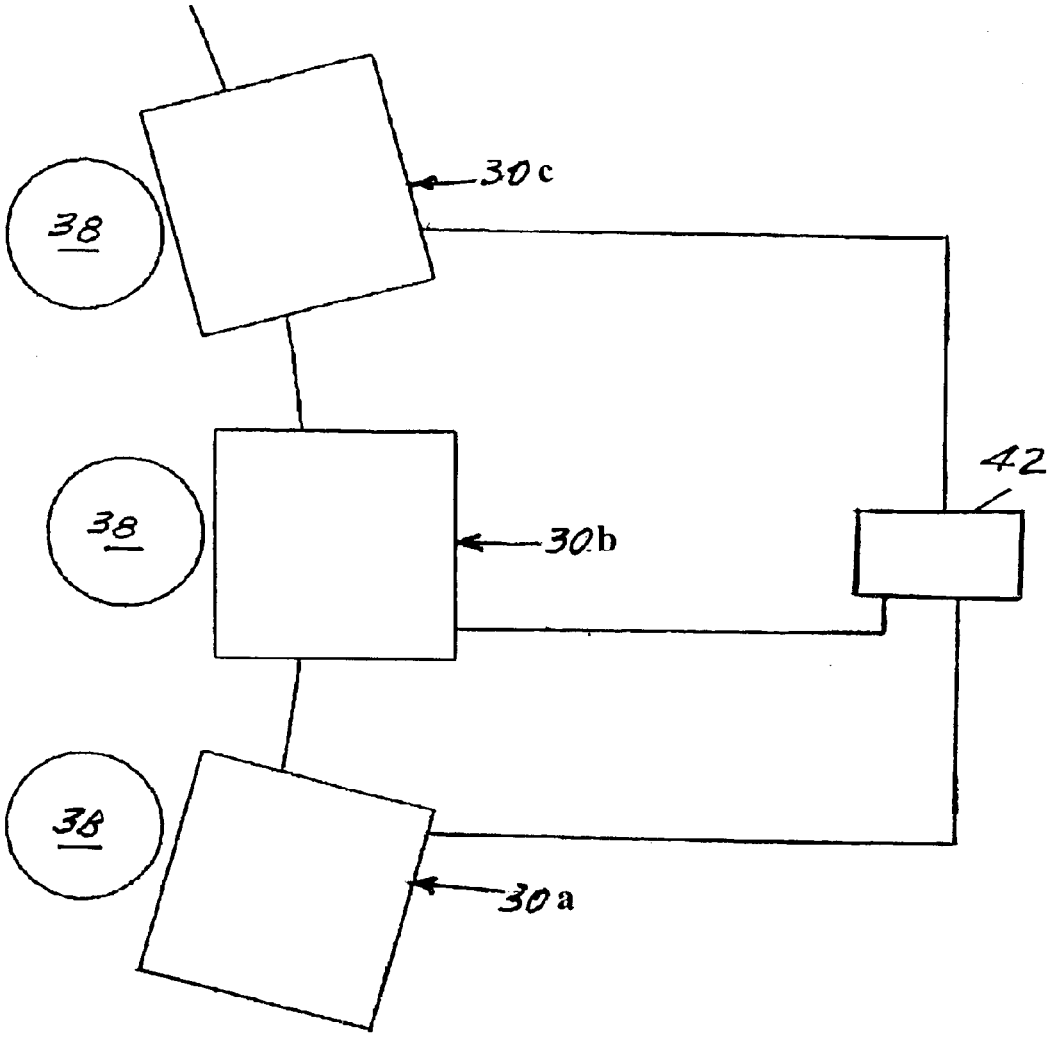
FIG. 3 is an enlarged schematic view of a portion of the inventive apparatus.

As seen in FIG. 3, a separate digitally controlled electronic print engine or head 30*a*, 30*b*, 30*c*, etc. is provided for each color ink. Each head prints its respective color ink directly to a can surface as the can 38 passes the respective print-heads 30. The print-heads in the present embodiment are similar to ink jet print-heads used in computer printers. Any appropriate size and configuration digitally controllable print head able to apply ink to a can, and preferably a non-contact print head, may be used.

Figure 4:
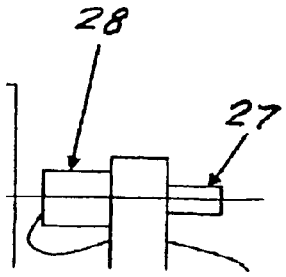
FIG. 4 is a view showing a mandrel which supports the cans.
Figure 5:
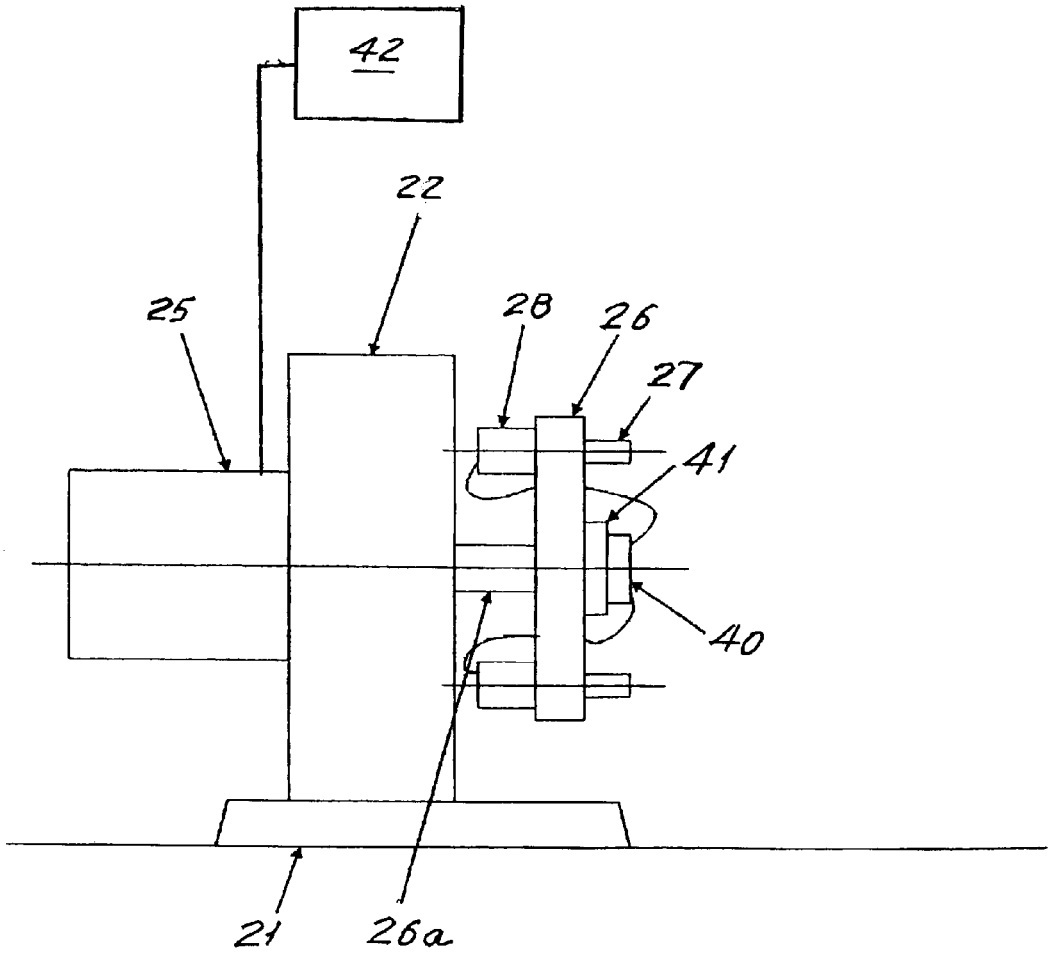
FIG. 5 is a schematic side view of the apparatus.

In order that the desired image containing the various colors of ink is accurately printed on the can, it is necessary to register and rotate each can in front of each of the digitally controlled print-heads. This registration rotation is accomplished directly, as shown in FIG. 4, by mandrel assemblies 27, 28. The cans 38 are held on the mandrel assemblies by vacuum, e.g. as shown in U.S. Pat. No. 6,167,805, incorporated by reference. The mandrels 27 are driven by individual servo motors 28. These servo motors 28 rotate the mandrels 27 to rotate the individual cans 38 in front of the print-heads 30 during printing so that the respective colors and patterns from the respective print-heads are appropriately registered. Furthermore, as shown in FIG. 5, the mandrels 27 and their servo motors 28 are mounted on a turret 26, which in turn is mounted on a support shaft 26*a*. The support shaft is mounted in the main support 22, which stands on the base 21. An indexing drive, such as a servo motor 25 is connected to the support shaft 26*a* so as to rotate the turret 26 so that each mandrel 27 along with the can 38 mounted on it, is moved along a circular path to be positioned in front of the respective print-heads 30 for an appropriate period of time to permit application of the appropriate ink color. The above-noted patent shows such a supported and rotatable turret. The rotation of the turret is coordinated with the rotation of the mandrels so as to permit sufficient time at each appropriate print-head to allow application of each ink color in a registered fashion on each can.

Electrical power is provided to the servo motors 28 for controlling the mandrels 27 by conventional slip ring technology 40. Control and programming signals for the servo motors 28 can also be provided by the slip ring 40. Any other type of technology which would provide a stable transmission of power or programming to the servo motors would also be acceptable. For example, the programming could be transmitted wirelessly.

The cans are held and released on the mandrels respectively by vacuum and air pressure. The vacuum and air pressure are supplied to the respective mandrels by a valve assembly 41 which is mounted on the support shaft 26*a*. See the above-noted patent.

Print-head printing control information, as well as the control signals for the servo motors 25, 28, is provided from a control unit, such as a computer 42. This control allows the image being printed to be easily changed by merely programming the desired image into the computer. The programming instructs the print-heads on the precise printing job to be performed by each print-head. This avoids the need for changing printing plates, as is necessary in the offset printing process of the prior art. It also avoids machine wear, printing pressure supply and support, and printing plate and blanket replacement, and possible wear thereof, all occurring in known contact printing. Furthermore, in the present invention, it is even possible to print a different image on each can due to the individual control of the print-heads and the non-contact printing.

Figure 6:
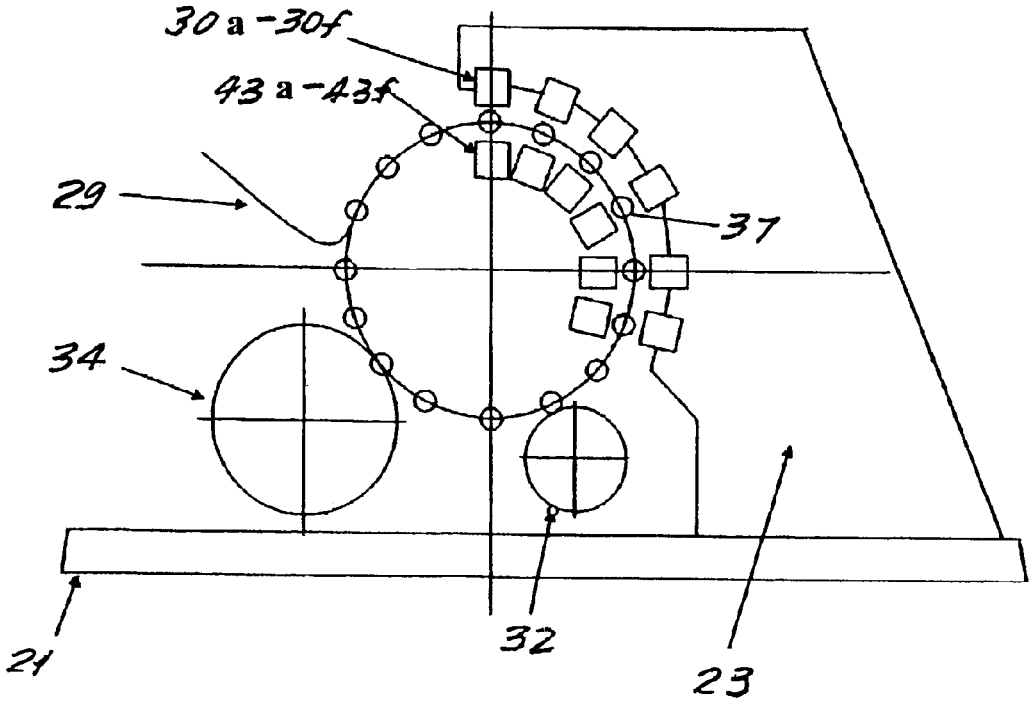
FIG. 6 is a front view of a second embodiment of the printing apparatus of the invention.
Figure 7:
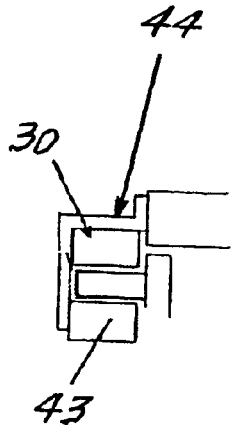
FIG. 7 is a detail showing the relationship between the mandrel and the print-heads in the second embodiment.

In an alternate embodiment shown in FIGS. 6 and 7, the support frame 23 mounted to the base 21 supports an additional row of print-heads 43*a*–43*f* mounted on the support frame 23 on an arc coaxial with the movement path of the mandrels 27. The first row of print-heads 30–30*f* are mounted, as described for the first embodiment, also on an arc coaxial with the movement of the mandrels. The heads 43*a–f* are inward while the heads 30*a–f* are outward of the mandrels. Each of the print-heads 43*a–f* is arranged on a common radius of the turret 26 with a respective one of the print-heads 30*a–f* so that respective print-heads in each row face one another. The print-heads 43 are radially spaced from the print-heads 30 so as to permit the mandrels 27 with the cans 38 mounted thereon to pass therebetween, as shown in FIG. 7. The print-heads 43 are arranged along an arc having a smaller radius than the arc of the print-heads 30. The print-heads are mounted to the support frame 23 by a bracket 44 so that all of the print- heads are supported by a single support frame and the spacing and orientation of the print-heads is maintained constant.

FIGS. 2 and 6 also schematically illustrates the infeed station 29 at which the cans are supplied to the printing apparatus and mounted on the mandrels. See the above-noted patent incorporated herein by reference. From here the cans are driven through the print-heads by the indexing means 25, which may be a servo motor. As each can reaches the respective print-head 30 (FIG. 3) or pair of print-heads (FIG. 6), the indexing means 25 pauses the shaft 26*a* and then the individual servo motors 28 rotate the mandrels 27 while the print-heads 30 emit ink. After this inking step is completed, the indexing means 25 advances the cans to the next print-head or pair of print-heads where the indexing means 25 again pauses and the servo motors 28 rotate the cans so that the ink pattern sprayed by the next print-heads are in appropriate register with the ink sprayed by the previous print-heads. After passing all of the print-heads, the printed cans pass a varnishing station. 32 at which a varnish is applied over the ink pattern. Then the cans are subsequently removed from the mandrels at a transfer station 34. See the above-noted patent incorporated herein by reference.

Use of the digitally controlled printing heads enables quickly changing the image being printed by reprogramming in the computer control. If desired, successive cans can be provided with different images, or with the same images in different colors without having to stop the printing apparatus or change printing plates of any type. If desired, it is also possible to print with only selected ones of the print-heads operating and not all of the print-heads of the apparatus. All this is made possible by the digitally controlled print-heads together with the concurrently controlled servo motors.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A digital can printing apparatus for printing on circular objects, each having a periphery the apparatus comprising:

a printer for digitally controlled printing of an image on the objects; and an object transporter for transporting the objects in front of the printer and in registered alignment between each object and the printer and for rotating the individual objects in front of the printer, the transporter supporting each object at a location not on the periphery of the object enabling the entire periphery of the object to be printed by rotation of the individual objects.

2. A digital can printing apparatus for printing on circular objects, comprising:

a printer for digitally controlled printing of an image on the objects; and an object transporter for transporting the objects in front of the printer and in registered alignment between each object and the printer and for rotating the individual objects in front of the printer, wherein the printer includes a plurality of spaced apart digitally controlled print-heads and the transporter is operable for moving the objects to selected ones of the print-heads, for then halting movement of the objects at the selected print-heads, for then rotating the objects while the objects are halted at the selected print-heads, wherein the print-heads are operable for digitally controlled printing of the object then at each of the print-heads.

3. The digital can printing apparatus of claim 2, wherein each print-head is operative to print a single color.

4. The digital can printing apparatus of claim 3, wherein each print-head is operative to print a respective printed pattern.

5. The digital can printing apparatus of claim 2, wherein each print-head is operative to print a respective printed pattern.

6. The digital can printing apparatus of claim 2, wherein the transporter includes a plurality of mandrels, each mandrel being sized to receive a respective one of the objects, and a plurality of servo motors, with a respective one of the servo motors being connected to each of the mandrels, the servo motors being operative to rotate and register the respective mandrels in front of each print-head to thereby directly drive the objects to rotate corresponding to an image to be printed on the object by the respective print-head.

7. A digital can printing apparatus of claim 6, wherein the transporter includes a rotatable turret on which the mandrels are mounted so that the mandrels follow a circular path of movement as the turret rotates.

8. The digital can printing apparatus of claim 7, wherein the transporter includes an indexing drive for rotating the turret.

9. The digital can printing apparatus of claim 8, wherein the indexing drive comprises a further servo motor.

10. The digital can printing apparatus of claim 9, further comprising a main support, the further servo motor, the support shaft and the turret being mounted on the main support.

11. The digital can printing apparatus of claim 6, further comprising devices for supplying vacuum or air pressure to the mandrels, and the mandrels are operatively configured to hold objects by vacuum and release objects by air pressure.

12. The digital can printing apparatus of claim 11, wherein the transporter includes a rotatable turret on which the mandrels are mounted so that the mandrels follow a circular path of movement as the turret rotates; and wherein the devices for supplying vacuum or air pressure comprise valves mounted on the support shall and the turret for supplying vacuum and air to each of the mandrels.

13. The digital can printing apparatus of claim 6, further comprising a computer control for controlling the servo motors of the mandrels for causing the mandrels to rotate and register pursuant to a selected image to be printed.

14. The digital can printing apparatus of claim 13, wherein the transporter includes a rotatable turret on which the mandrels are mounted so that the mandrels follow a circular path of movement as the turret rotates; and wherein the computer control is further operative to control the further servo motor for the turret so that each of the mandrels is positioned in front of each of the print-heads for a predetermined period of time during which time the mandrels are rotated so that ink is applied in register by the print-heads.

15. The digital can printing apparatus of claim 2, further comprising a computer control for controlling the image printed on the objects.

16. The digital can printing apparatus of claim 10, further comprising a print-head support, the print-heads being mounted on the print-head support so that the print-heads are directed toward the mandrels mounted on the turret as the mandrels move along the circular path of movement.

17. The digital can printing apparatus of claim 16, further comprising a base and the main support and the print-head support being mounted on the base.

18. The digital can printing apparatus of claim 12, wherein the print-heads are arranged in two groups, each group of print heads being arranged along an arc concentric with the circular path of movement, wherein one arc has a radius smaller than the radius of the circular path of movement of the mandrels and another arc has a radius larger than the radius of the circular path of movement.

19. The digital can printing apparatus of claim 18, wherein each of the print heads of one group is arranged opposed to one of the print heads of the other group and the path of movement of the mandrels passes between the opposed print-heads.

20. The digital can printing apparatus of claim 7, further comprising a feeder for feeding the objects to the mandrels prior to printing, a varnishing device for varnishing the objects after printing, and a transfer device for transferring the objects from the mandrels after varnishing.

21. The digital can printing apparatus of claim 2, wherein the print-heads are ink-jet print-heads.

22. The digital can printing apparatus of claim 21, further comprising an ink reservoir on the apparatus and connected with the print-heads for supplying ink to the print-heads.

23. A method of decorating circular objects in a decorating apparatus, comprising:

supplying the circular objects to the apparatus, transporting the objects through the apparatus at selected intervals of travel of the objects through the apparatus and halting the transport after each interval;

at the halting of the transport of the objects through the apparatus, rotating the objects and while rotating the objects, digitally printing the rotating objects;

after having the digital printing, moving the objects another interval of travel and selectively halting the objects and digitally printing the objects again at the next location.

24. The method of claim 23, further comprising before transporting the objects through the apparatus, applying the objects on respective rotation mandrels;

transporting the object through the apparatus by moving the mandrels, and at the selected locations where the mandrels and objects are halted, rotating the objects by rotating the mandrels thereof; and after the printing of the objects, removing the objects from the mandrels.

* * * * *